US012234822B1

(12) United States Patent
Yang

(10) Patent No.: US 12,234,822 B1
(45) Date of Patent: Feb. 25, 2025

(54) COMPRESSOR FORMED BY IDENTICAL ROTORS WITH CIRCULAR ARCS

(71) Applicant: Yaode Yang, Fresh Meadows, NY (US)

(72) Inventor: Yaode Yang, Fresh Meadows, NY (US)

( * ) Notice: Subject to any disclaimer, the term of this patent is extended or adjusted under 35 U.S.C. 154(b) by 0 days.

(21) Appl. No.: 18/371,548

(22) Filed: Sep. 22, 2023

(51) Int. Cl.
*F04C 18/12* (2006.01)
*F04C 18/18* (2006.01)
*F04C 29/00* (2006.01)

(52) U.S. Cl.
CPC ..... *F04C 18/126* (2013.01); *F04C 18/18* (2013.01); *F04C 29/005* (2013.01); *F04C 2240/20* (2013.01); *F04C 2250/20* (2013.01)

(58) Field of Classification Search
CPC ..... F04C 18/126; F04C 18/18; F04C 29/005; F04C 2240/20; F04C 2250/20
See application file for complete search history.

(56) References Cited

U.S. PATENT DOCUMENTS 2,845,909 A * 8/1958 Pitkanen ..... F01C 1/126 418/204
4,666,383 A * 5/1987 Mendler, III ..... F01C 1/28 418/142
6,604,503 B2 * 8/2003 Mekler ..... F04C 18/28 123/241
6,886,528 B2 * 5/2005 James ..... F01C 1/28 418/204

FOREIGN PATENT DOCUMENTS

DE 2412888 A1 * 10/1975

* cited by examiner

*Primary Examiner* — Mary A Davis
(74) *Attorney, Agent, or Firm* — IPRO, PLLC

(57) ABSTRACT

An apparatus has a housing having a prismatic interior chamber with a base of a shape of two partially overlapping circles; a first rotor and a second rotor rotatably fit in the prismatic interior chamber. The first rotor and the second rotor are configured to rotate in the same direction. The first rotor and the second rotor are prismatic in shape and the base of the first rotor has a first circular arc and a second circular arc. The first circular arc and the second circular arc are concentric. The first circular arc has a smaller radius than the second circular arc. The first circular arc and the second circular arc have the same central angle. The apparatus may function as a compressor or a pump.

17 Claims, 7 Drawing Sheets

COMPRESSOR FORMED BY IDENTICAL ROTORS WITH CIRCULAR ARCS

BACKGROUND

Mechanical power can be derived from pressure differential of fluid such as steam. The history of the steam engine stretches back as far as the first century AD. James Watt developed a steam engine that provides a rotary motion suitable for driving factory machinery. This enabled factories to be sited away from rivers, and further accelerated the pace of the Industrial Revolution. Around 1800, Richard Trevithick introduced engines using high-pressure steam. These were much more powerful than previous engines and could be made small enough for transport applications.

A reciprocating compressor or piston compressor is a positive-displacement compressor that uses pistons driven by a crankshaft to deliver gases at high pressure. The intake gas enters the suction manifold, then flows into the compression cylinder where it gets compressed by a piston driven in a reciprocating motion via a crankshaft and is then discharged. Applications of a reciprocating compressor include oil refineries, gas pipelines, chemical plants, natural gas processing plants and refrigeration plants.

SUMMARY

Disclosed herein is an apparatus comprising: a housing having a prismatic interior chamber with a base of a shape of two partially overlapping circles; a first rotor and a second rotor rotatably fit in the prismatic interior chamber. The first rotor and the second rotor are configured to rotate in a same direction. The first rotor and the second rotor are prismatic in shape and a base of the first rotor has a first circular arc and a second circular arc. The first circular arc and the second circular arc are concentric. The first circular arc has a smaller radius than the second circular arc. The first circular arc and the second circular arc have a same central angle.

In an aspect, a base of the second rotor has a same shape as the base of the first rotor.

In an aspect, the base of the first rotor and the base of the second rotor are identical.

In an aspect, the first rotor and the second rotor are identical.

In an aspect, the base of the first rotor has a third circular arc and a fourth circular arc. The first circular arc joins the third circular arc. The second circular arc joins the fourth circular arc. The third circular arc and the fourth circular arc are concentric and have a same central angle.

In an aspect, the third circular arc has a smaller radius than the fourth circular arc.

In an aspect, the first circular arc is tangent to the third circular arc and the second circular arc is tangent to the fourth circular arc.

In an aspect, a sum of the radius of the first circular arc and the radius of the second circular arc equals a sum of the radius of the third circular arc and the radius of the fourth circular arc, and equals a distance between a rotational axis of the first rotor and a rotational axis of the second rotor.

In an aspect, an angle between the first rotor and a plane spanned by a rotational axis of the first rotor and a rotational axis of the second rotor always equals an angle between the second rotor and the plane.

In an aspect, the second circular arc forms a seal with the prismatic interior chamber.

In an aspect, the prismatic interior chamber, the first rotor and the second rotor form a first enclosed space and a second enclosed space during rotation of the first rotor and the second rotor and the first enclosed space forms and then contracts and the second enclosed space forms and then expands during rotation of the first rotor and the second rotor.

In an aspect, the apparatus further comprises a first shaft and a second shaft, and the first rotor is fixedly connected to the first shaft and the second rotor is fixedly connected to the second shaft.

In an aspect, the first shaft and the second shaft respectively have a first crankshaft and a second crankshaft.

In an aspect, the first crankshaft and the second crankshaft have an identical eccentric distance respectively with a rotational axis of the first rotor and a rotation axis of the second rotor.

In an aspect, the apparatus further comprises a drive plate rotatably connected to the first crankshaft and the second crankshaft and the driving plate is configured to keep a distance between a center line of the first crankshaft and a center line of the second crankshaft equal to a distance between a rotational axis of the first rotor and a rotation axis of the second rotor.

In an aspect, the first rotor comprises a notch on a side and the notch is configured to allow fluid to flow into the second enclosed space.

In an aspect, the first circular arc and the second circular arc are concentric with a rotational axis of the first rotor.

In an aspect, a center of mass of the first rotor is on a rotational axis of the first rotor.

In an aspect, the base of the first rotor has multiple pairs of circular arcs and the circular arc in each pair are concentric with each other and have a same central angle.

DETAILED DESCRIPTION

Figure 1:
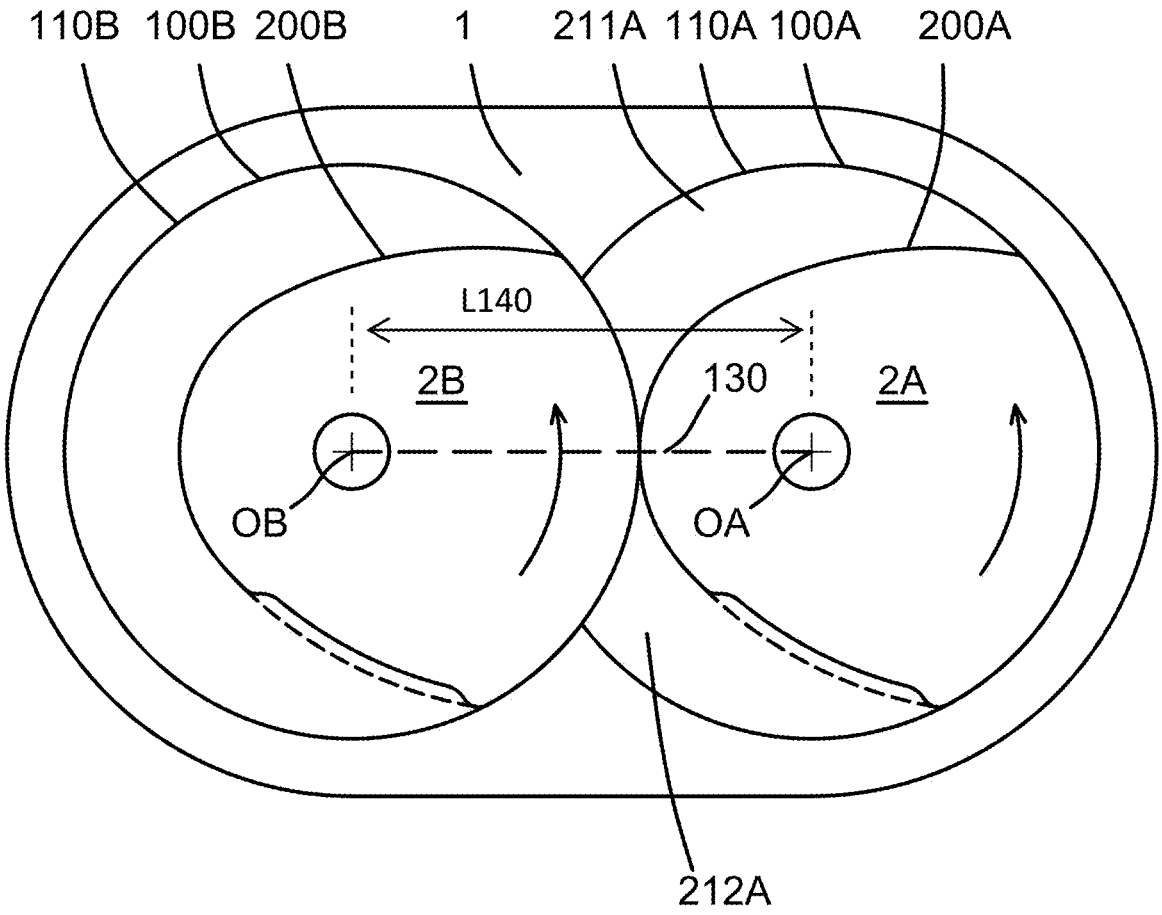
FIG. 1 shows an end view of the interior of a compressor.

FIG. 1 shows an end view of the interior of a compressor. The compressor has a housing 1. The housing has a prismatic interior chamber with a base of the shape of two partially overlapping circles 110A and 110B. The inner surface of the housing 1, i.e., the side surface of the prismatic interior chamber, has two sections 100A and 100B. The word "prismatic" does not mean that the base of a prismatic body must be a polygon made of straight line segments; instead, a prismatic shape may have a base made of combinations of curve segments (i.e., arcs) and straight line segments or combinations of only curve segments. For example, a cylinder is prismatic. In an embodiment, both sections 100A and 100B are major arc sections of cylindrical surfaces. The cylindrical surfaces may have the same diameter. Because FIG. 1 is an end view, both sections 100A and 100B appear major arcs of a circle. The compressor may have a first rotor 2A and a second rotor 2B rotatably fit in the prismatic interior chamber. The first rotor 2A is configured to rotate around an axis OA and the second rotor 2B is configured to rotate around an axis OB. The axis OA may be the axis of the section 100A and the axis OB may be the axis of the section 100B.

Figure 2:
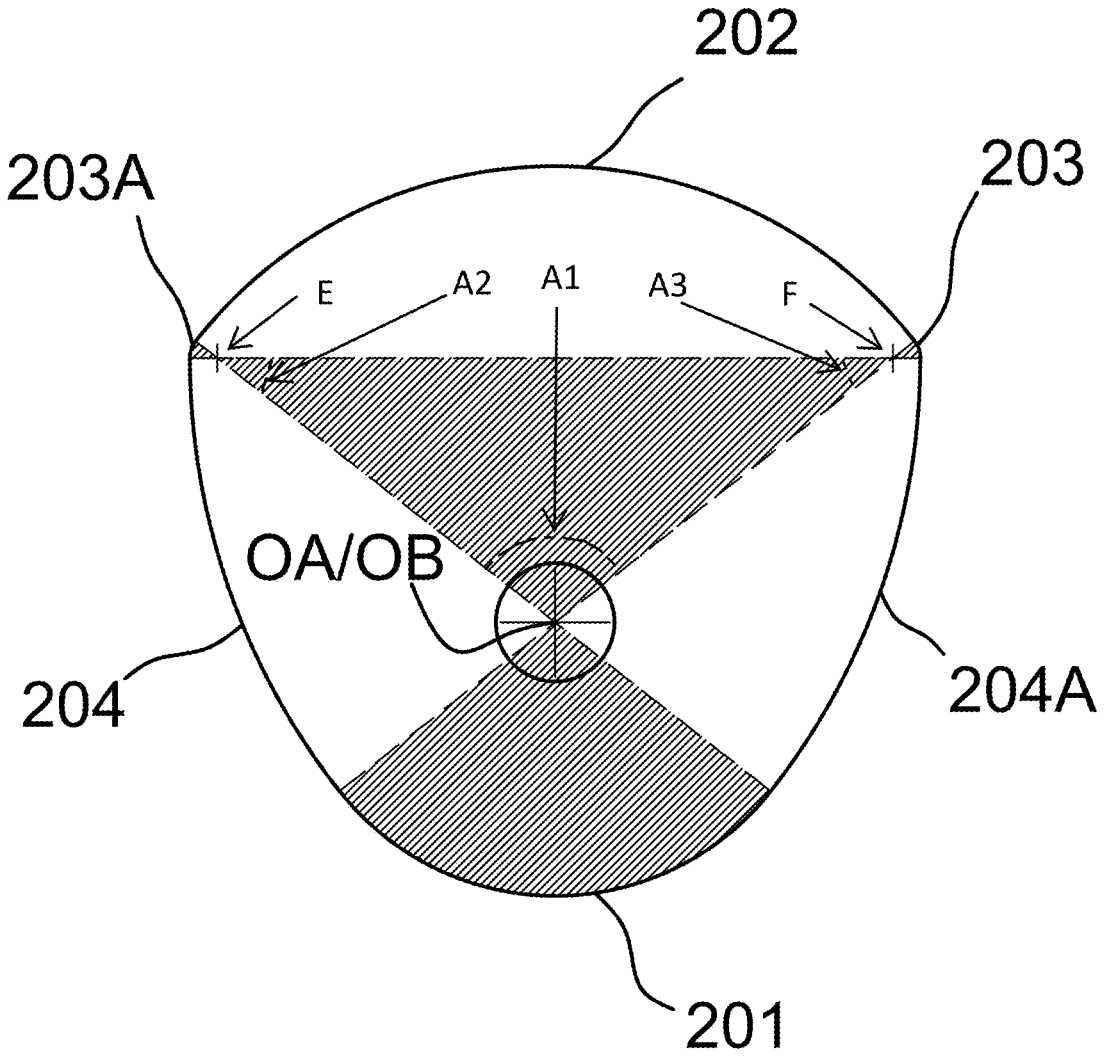
FIG. 2 shows the shape of one rotor of the compressor, along the rotational axis of the rotor.

The first rotor 2A and the second rotor 2B are both prismatic in shape. FIG. 2 shows an end view of one of the first rotor 2A and the second rotor 2B. Namely, FIG. 2 shows the shape of the base of the first rotor 2A and the second rotor 2B. In an embodiment, the bases of the first rotor 2A and the second rotor 2B have the same shape. In an embodiment, the bases of the first rotor 2A and the second rotor 2B are identical. In an embodiment, a side surface 200A of the first rotor 2A and a side surface 200B of the second rotor 2B are identical. In an embodiment, the first rotor 2A and the second rotor 2B are identical. The base of the first rotor 2A or the second rotor 2B has a plurality of sections shown in FIG. 2. Two of the sections are circular arcs 201 and 202 that are concentric. The common center of the circular arcs 201 and 202 are on the rotational axis OA or OB. The circular arcs 201 and 202 may have the same central angle A1. The circular arc 201 has a smaller radius than the circular arc 202. The circular arc 202 joins, at its ends respectively, circular arc 203 and circular arc 203A. Both the circular arc 203 and circular arc 203A are among the sections of the base. The circular arc 203 and circular arc 203A are identical in shape. The circular arc 203 joins another of the sections, which is circular arc 204A. The circular arc 203A joins another of the sections, which is circular arc 204. The circular arc 204 and the circular arc 204A join the circular arc 201. The circular arc 204 and the circular arc 204A are identical in shape. The circular arc 203 and the circular arc 204 are concentric at point F and have the same central angle A3. The circular arc 203 has a smaller radius than the circular arc 204. The circular arc 203A and the circular arc 204A are concentric at point E and have the same central angle A2. The circular arc 203A has a smaller radius than the circular arc 204A. In an embodiment, each of the circular arcs described above is tangent to its immediate neighboring circular arcs. Namely, each of the circular arcs described above and its immediate neighboring circular arc have the same slope at their joint. In an embodiment, the radii of the circular arcs described above have the relationship of R1+R2=R3+R4=L140. L140 is the distance between the axis OA and the axis OB shown in FIG. 1. R1 is the radius of the circular arc 201. R2 is the radius of the circular arc 202. R3 is the radius of the circular arc 203 and the radius of the circular arc 203A. R4 is the radius of the circular arc 204 and the radius of the circular arc 204A. In an embodiment, R3 may approach zero. In an embodiment, the base of the first rotor 2A or the second rotor 2B has multiple pairs of circular arcs. In each pair, the circular arcs are concentric with each other and have the same central angle. In each pair, the circular arcs may be opposite and defined by the same pair of diameters. In an embodiment, the sums of the radii of the circular arcs of the respective pairs are the same.

FIGS. 3A-3F show locations of the first rotor 2A and the second rotor 2B relative to the sections 100A and 100B, as the first rotor 2A and the second rotor 2B rotate around axis OA and axis OB respectively inside the prismatic interior chamber. The circular arc 202 forms a seal with the section 100A or the section 100B. The circular arc 202 may have the same radius as the section 100A or the section 100B. The circular arc 202 of the first rotor 2A and the circular arc 201 of the second rotor 2B form a seal. The circular arc 202 of the second rotor 2B and the circular arc 201 of the first rotor 2A form a seal. Enclosed spaces, such as enclosed spaces 211A, 212A, 211B and 212B, form between the section 100A or the section 100B, the side surface 200A of the first rotor 2A, and the side surface 200B of the second rotor 2B during rotation of the first rotor 2A and the second rotor 2B. Specifically, the enclosed space 211A and the enclosed space 212A are formed by the section 100A, the side surface 200A and the side surface 200B; the enclosed space 211B and the enclosed space 212B are formed by the section 100B, the side surface 200A and the side surface 200B.

Figure 3A:
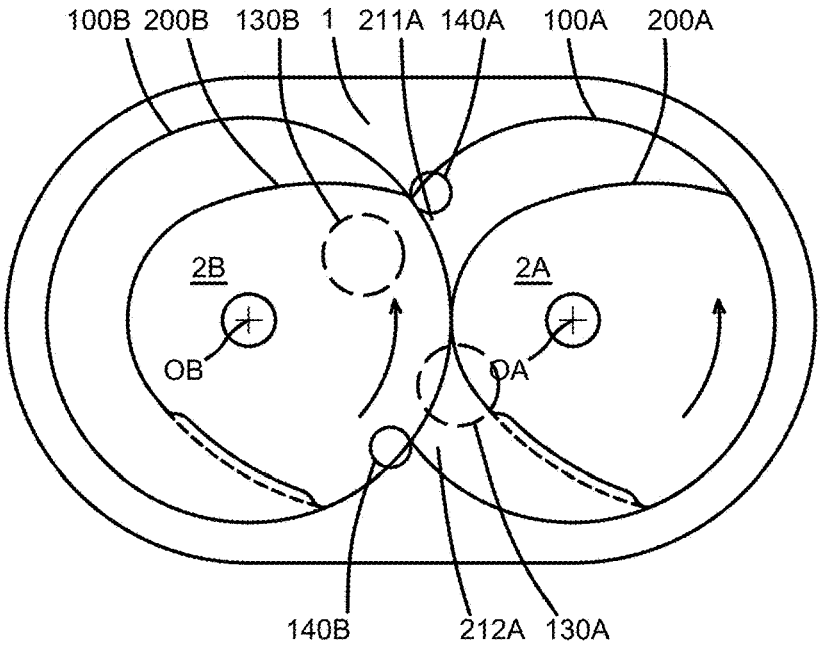
FIG. 3A through FIG. 3F are views showing the inner surface of the compressor and the rotors at six rotating positions in one cycle of the compressor.
Figure 3B:
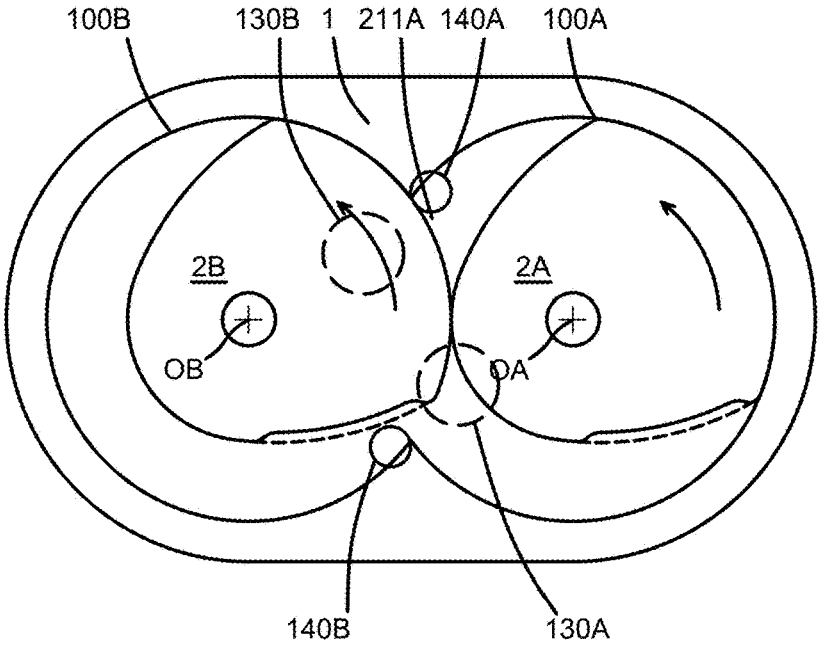
Figure 3C:
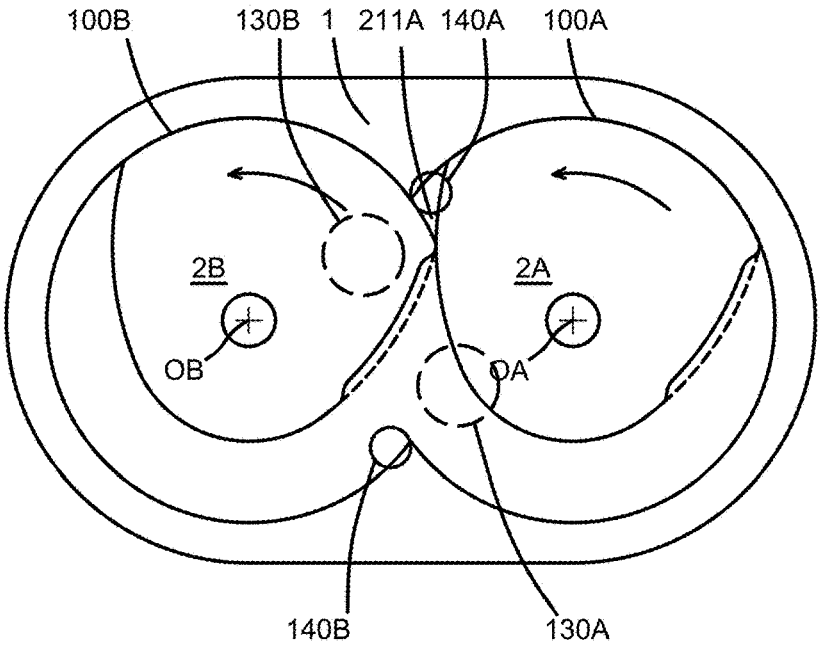
Figure 3D:
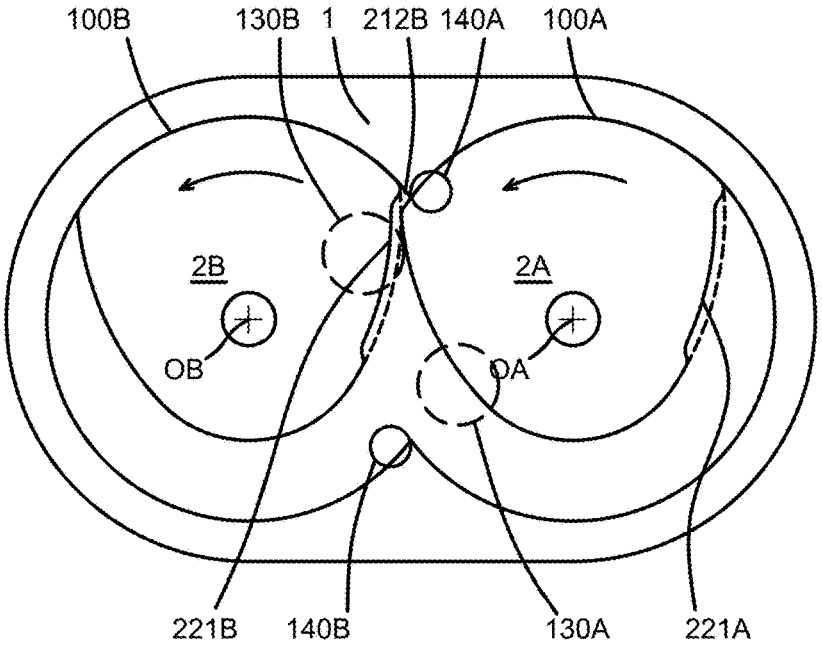
Figure 3E:
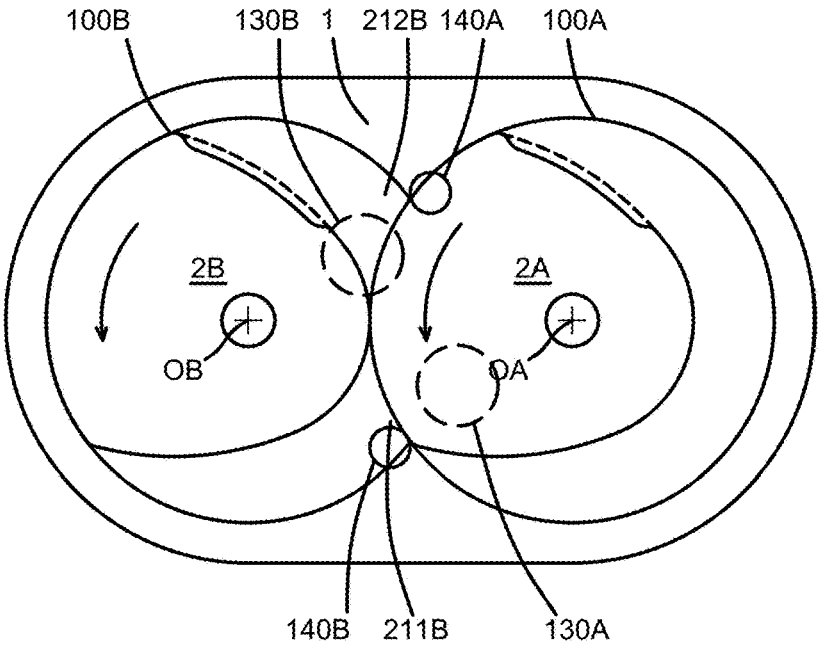
Figure 3F:
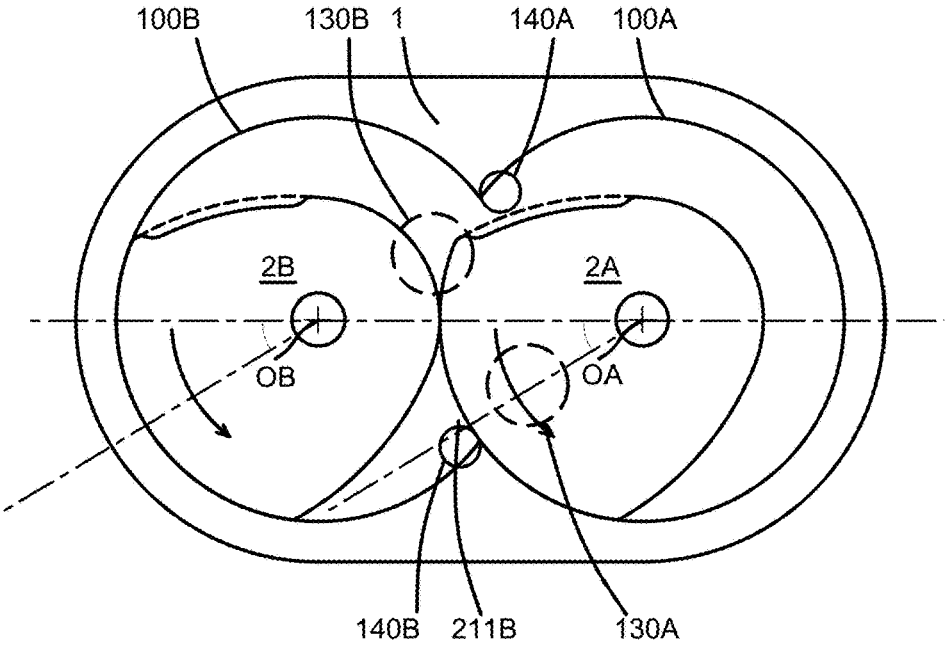

The volumes of the enclosed spaces 211A, 212A, 211B and 212B change during rotation of the first rotor 2A and the second rotor 2B. For example, the enclosed spaces 211A and 211B periodically form, contract, and essentially disappear (by being reduced to almost nothing or a minimum volume, e.g., enclosed space 211A disappearing as shown in FIGS. 3C and 3D); the enclosed spaces 212A and 212B periodically form, expand, and disappear (by the seals breaking, e.g., enclosed space 212B disappearing as shown in FIGS. 3E and 3F). The enclosed spaces 211A and 211B can be used as compression chambers to compress and/or increase pressure of fluid therein and discharge the fluid through opening 140A and opening 140B respectively. The opening 140A and opening 140B may be on an end wall of the house 1. The enclosed spaces 212A and 212B can be used as intake chambers to draw fluid to be compressed through opening 130A and opening 130B respectively. The opening 130A and opening 130B may be on an end wall of the house 1.

When the enclosed spaces 212A and 212B start forming (e.g., FIG. 3D showing the enclosed space 212B starts forming), the opening 130A and the opening 130B are not respectively connected to the enclosed spaces 212A and 212B yet. The first rotor 2A and the second rotor 2B may respectively have notches 221A and 221B on a side to allow fluid to flow into the enclosed spaces 212A and 212B from other places in the prismatic interior chamber. For example, as shown in FIG. 3D, the notch 221B allows fluid to flow into the enclosed space 212B that just starts forming, from the portion of the prismatic interior chamber not occupied by the first rotor 2A and the second rotor 2B.

Figure 4:
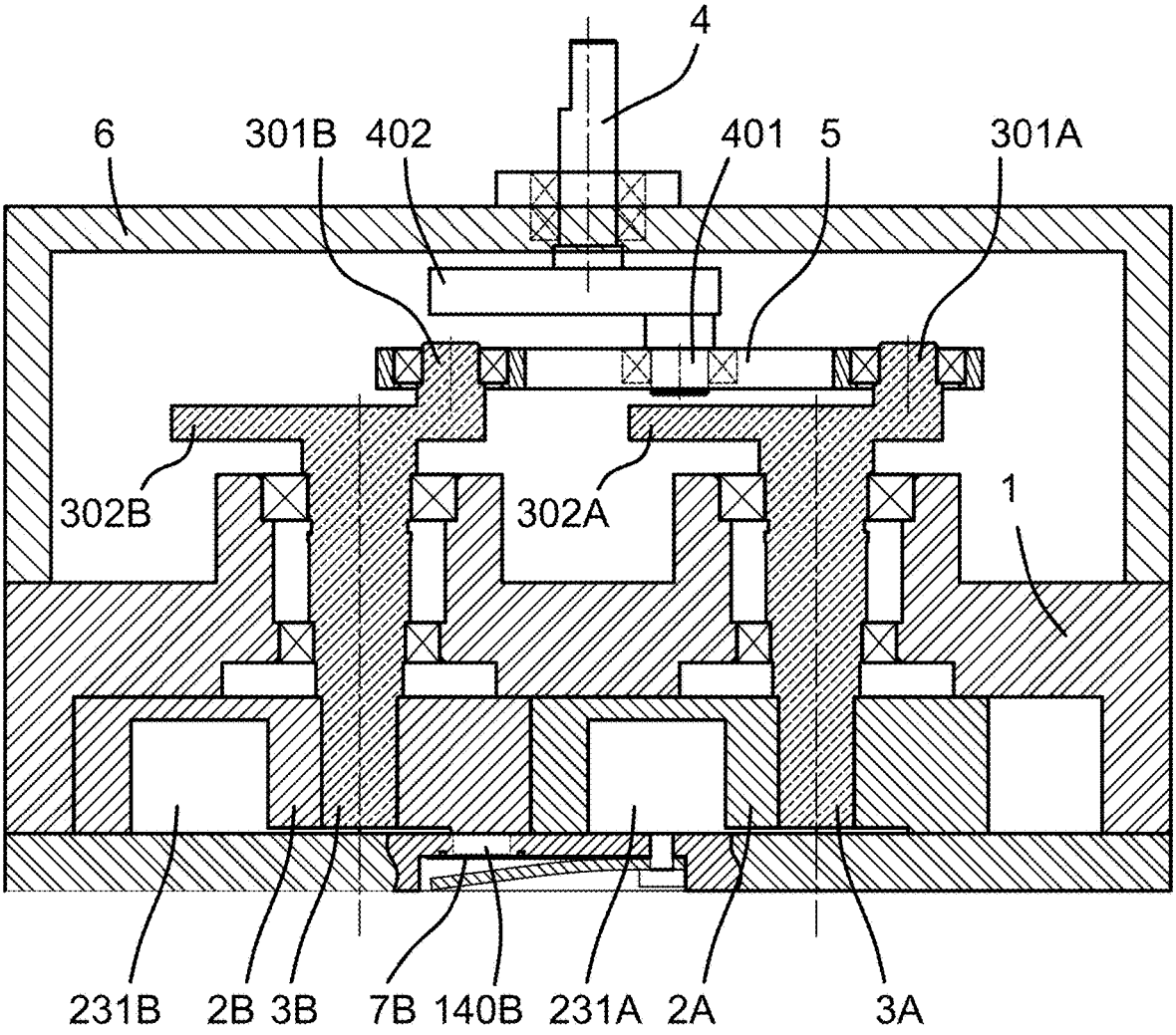
FIG. 4 is the section view through both center lines of the shafts of the rotors.

FIG. 4 is a section view through a plane spanned by the axes OA and OB, according to an embodiment. In this embodiment, the compressor has a first shaft 3A and a second shaft 3B, the first rotor 2A is fixedly connected to the first shaft 3A, and the second rotor 2B is fixedly connected to the second shaft 3B. The first shaft 3A and the second shaft 3B may respectively have a first crankshaft 301A and a second crankshaft 301B. The first crankshaft 301A and the second crankshaft 301B have identical eccentric distance respectively with the axes OA and OB. The compressor may have a drive plate 5 rotatably connected to the first crankshaft 301A and the second crankshaft 301B. The driving plate 5 keeps the distance between the center line of the first crankshaft 301A and the center line of the second crankshaft 301B equal to the distance L140 between the axes OA to OB, as shown in FIG. 4. The first rotor 2A, the second rotor 2B, the first shaft 3A, and the second shaft 3B are configured to keep the first rotor 2A and the second rotor 2B synchronized. Namely, during rotation of the first rotor 2A and the second rotor 2B, their angles relative to a plane 130 through the axes OA and OB are equal. The first shaft 3A and the second shaft 3B may respectively have counterweight parts 302A and 302B on the opposite side of the first crankshaft 301A and the second crankshaft 301B respectively. The first rotor 2A and the second rotor 2B may have pocket 231A and 231B respectively to reduce vibration during rotation. In an embodiment, the center of mass of the first rotor 2A is on the axis OA and the center of mass of the second rotor 2B is on the axis OB.

The compressor may have a driving box 6 secured to the housing 1. A driving shaft 4 is rotatably connected to the driving box 6 through a housing bearing. The driving shaft 4 rotatably connects to the driving plate 5 through a crankshaft 401. The eccentric distance between centers of the driving shaft 4 and the crankshaft 401 equals the eccentric distance from the centers of the first crankshaft 301A and the second crankshaft 301B to the centers of the first shaft 3A and the second shaft 3B respectively. When the driving shaft 4 rotates around its center, the crankshaft 401 drives the driving plate 5 and the first crankshaft 301A and the second crankshaft 301B, and in turn the first shaft 3A and the second shaft 3B and the first rotor 2A and the second rotor 2B. The driving shaft 4 may have a counterweight part 402 at the opposite side of the crankshaft 401.

The opening 140A and the opening 140B may each have a check valve 7B (e.g., a reed valve) outside the prismatic interior chamber to prevent the pressurized fluid flowing back in after the compression process finishes.

Figure 5:
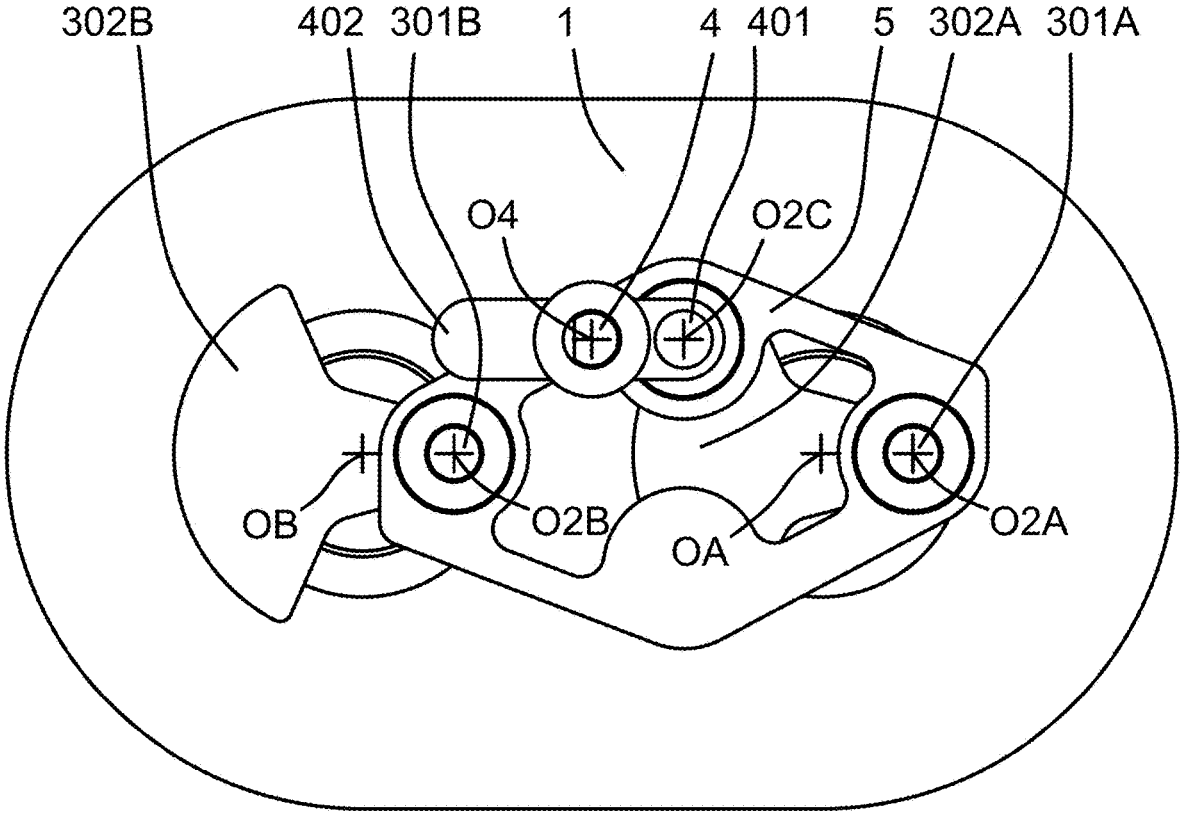
FIG. 5 is the end view of the connection between two crankshafts and the drive crankshaft of the compressor.

FIG. 5 is the end view of the connection among the first crankshaft 301A, the second crankshaft 301B and the driving shaft 4. O4 is the axis of the driving shaft 4. The driving box 6 is omitted in FIG. 5 for clarity. The driving plate 5 may have 3 bearing housings. A bearing housing center O2A is concentric with the first crankshaft 301A, a bearing housing center O2B is concentric with the second crankshaft 301B, a bearing housing center O2C is concentric with the crankshaft 401. The driving plate 5 has an orbiting motion when the driving shaft 4 rotates.

In relation to the claims, it is intended that when words such as "a," "an," "at least one," or "at least one portion" are used to preface a feature there is no intention to limit the claim to only one such feature unless specifically stated to the contrary in the claim.

The descriptions above are intended to be illustrative, not limiting. Thus, it will be apparent to one skilled in the art that modifications may be made without departing from the scope of the claims set out below.

What is claimed is:

1. An apparatus comprising:

a housing having a prismatic interior chamber with a base of a shape of two partially overlapping circles;

a first rotor and a second rotor rotatably fit in the prismatic interior chamber;

a first shaft and a second shaft;

wherein the first rotor and the second rotor are configured to rotate in a same direction;

wherein the first rotor and the second rotor are prismatic in shape and a base of the first rotor has a first circular arc and a second circular arc;

wherein the first circular arc and the second circular arc are concentric;

wherein the first circular arc has a smaller radius than the second circular arc;

wherein the first circular arc and the second circular arc have a same central angle;

wherein the first rotor is fixedly connected to the first shaft and the second rotor is fixedly connected to the second shaft; and wherein the first shaft and the second shaft respectively have a first crankshaft and a second crankshaft.

2. The apparatus of claim 1, wherein a base of the second rotor has a same shape as the base of the first rotor.

3. The apparatus of claim 2, wherein the base of the first rotor and the base of the second rotor are identical.

4. The apparatus of claim 1, wherein the first rotor and the second rotor are identical.

5. The apparatus of claim 1, wherein the base of the first rotor has a third circular arc and a fourth circular arc;

wherein the first circular arc joins the third circular arc;

wherein the second circular arc joins the fourth circular arc; and wherein the third circular arc and the fourth circular arc are concentric and have a same central angle.

6. The apparatus of claim 5, wherein the third circular arc has a smaller radius than the fourth circular arc.

7. The apparatus of claim 5, wherein the first circular arc is tangent to the third circular arc; and wherein the second circular arc is tangent to the fourth circular arc.

8. The apparatus of claim 5, wherein a sum of the radius of the first circular arc and the radius of the second circular arc equals a sum of the radius of the third circular arc and the radius of the fourth circular arc, and equals a distance between a rotational axis of the first rotor and a rotational axis of the second rotor.

9. The apparatus of claim 1, wherein an angle between the first rotor and a plane spanned by a rotational axis of the first rotor and a rotational axis of the second rotor always equals an angle between the second rotor and the plane.

10. The apparatus of claim 1, wherein the second circular arc forms a seal with the prismatic interior chamber.

11. The apparatus of claim 1, wherein the prismatic interior chamber, the first rotor and the second rotor form a first enclosed space and a second enclosed space during rotation of the first rotor and the second rotor; and wherein the first enclosed space forms and then contracts and the second enclosed space forms and then expands during rotation of the first rotor and the second rotor.

12. The apparatus of claim 1, wherein the first crankshaft and the second crankshaft have an identical eccentric distance respectively with a rotational axis of the first rotor and a rotation axis of the second rotor.

13. The apparatus of claim 1, further comprising a drive plate rotatably connected to the first crankshaft and the second crankshaft; wherein the driving plate is configured to keep a distance between a center line of the first crankshaft and a center line of the second crankshaft equal to a distance between a rotational axis of the first rotor and a rotation axis of the second rotor.

14. The apparatus of claim 1, wherein the first circular arc and the second circular arc are concentric with a rotational axis of the first rotor.

15. The apparatus of claim 1, wherein the base of the first rotor has multiple pairs of circular arcs; and wherein the circular arc in each pair are concentric with each other and have a same central angle.

16. An apparatus comprising:

a housing having a prismatic interior chamber with a base of a shape of two partially overlapping circles;

a first rotor and a second rotor rotatably fit in the prismatic interior chamber;

wherein the first rotor and the second rotor are configured to rotate in a same direction;

wherein the first rotor and the second rotor are prismatic in shape and a base of the first rotor has a first circular arc and a second circular arc;

wherein the first circular arc and the second circular arc are concentric;

wherein the first circular arc has a smaller radius than the second circular arc;

wherein the first circular arc and the second circular arc have a same central angle;

wherein the prismatic interior chamber, the first rotor and the second rotor form a first enclosed space and a second enclosed space during rotation of the first rotor and the second rotor;

wherein the first enclosed space forms and then contracts and the second enclosed space forms and then expands during rotation of the first rotor and the second rotor; and wherein the first rotor comprises a notch on a side; and wherein the notch is configured to allow fluid to flow into the second enclosed space.

17. An apparatus comprising:

a housing having a prismatic interior chamber with a base of a shape of two partially overlapping circles;

a first rotor and a second rotor rotatably fit in the prismatic interior chamber;

wherein the first rotor and the second rotor are configured to rotate in a same direction;

wherein the first rotor and the second rotor are prismatic in shape and a base of the first rotor has a first circular arc and a second circular arc;

wherein the first circular arc and the second circular arc are concentric;

wherein the first circular arc has a smaller radius than the second circular arc;

wherein the first circular arc and the second circular arc have a same central angle; and wherein a center of mass of the first rotor is on a rotational axis of the first rotor.

* * * * *